US007832215B2

(12) United States Patent
Atkinson

(10) Patent No.: US 7,832,215 B2
(45) Date of Patent: Nov. 16, 2010

(54) THERMOELECTRICALLY COOLING ELECTRONIC DEVICES

(75) Inventor: Robert R. Atkinson, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 1547 days.

(21) Appl. No.: 10/804,522

(22) Filed: Mar. 19, 2004

(65) Prior Publication Data

US 2005/0204747 A1 Sep. 22, 2005

(51) Int. Cl.
*F25B 21/02* (2006.01)

(52) U.S. Cl. ..... 62/3.7; 62/3.2

(58) Field of Classification Search ..... 62/3.2, 62/3.3, 3.6, 3.7, 259.1, 259.2, 238.7
See application file for complete search history.

(56) References Cited

U.S. PATENT DOCUMENTS 4,622,822 A * 11/1986 Beitner ..... 62/3.2
5,355,678 A * 10/1994 Beitner ..... 62/3.2
5,670,914 A * 9/1997 Liberman et al. ..... 331/94.1
6,062,911 A * 5/2000 Davis et al. ..... 439/630
6,532,746 B1 * 3/2003 Bloom et al. ..... 62/3.7
6,543,246 B2 * 4/2003 Wayburn et al. ..... 62/259.2

* cited by examiner

*Primary Examiner*—Melvin Jones
(74) *Attorney, Agent, or Firm*—Trop, Pruner & Hu, P.C.

(57) ABSTRACT

A heat sink may be clamped to a thermoelectric cooler and vapor chamber using a U-shaped retention band. The band may attach underneath the vapor chamber, extending around the thermoelectric cooler, and over a heat sink. The heat sink may include a plate to distribute the force of the band across the heat sink. Bolts may be utilized to transfer the force from the free ends of the U-shaped retention band to a vapor chamber support frame. Thus, in some embodiments of the present invention, a thermoelectric cooler may be clamped to a heat sink without wasting heat transfer area through the use of bolts, without unnecessary bending, and without requiring a relatively thick base on the heat sink.

22 Claims, 5 Drawing Sheets

THERMOELECTRICALLY COOLING ELECTRONIC DEVICES

BACKGROUND

This invention relates generally to techniques for cooling integrated circuits.

Integrated circuits may develop heat in the course of operation. This heat may result in device failure. It may also adversely affect the performance of the overall system, including the electronic device. Therefore, it is desirable to cool the electronic device and systems using the electronic device.

To this end, a variety of cooling techniques have been used for cooling electronic devices. A thermoelectric cooler generates cool temperatures proximate to an electric component. The thermoelectric cooler may operate in conjunction with a heat sink. In such cases, there is a need for techniques for joining the heat sink, the thermoelectric cooler, and the component to be cooled.

Because the heat sink may have relatively little rigidity, simply bolting the parts together may result in bending moments at the edges, which may result in bowing of the heat sink. Such bowing of the heat sink may result in insufficient thermal interface between the heat sink and the thermoelectric cooler. That insufficient thermal interface results in less effective cooling. Using a thicker heat sink base is one solution. However, the resistance to thermal dissipation is a function of the thickness of the heat sink base.

Thus, there is a need for better ways to form thermoelectric cooling devices for electronic circuits.

DETAILED DESCRIPTION

Figure 1:
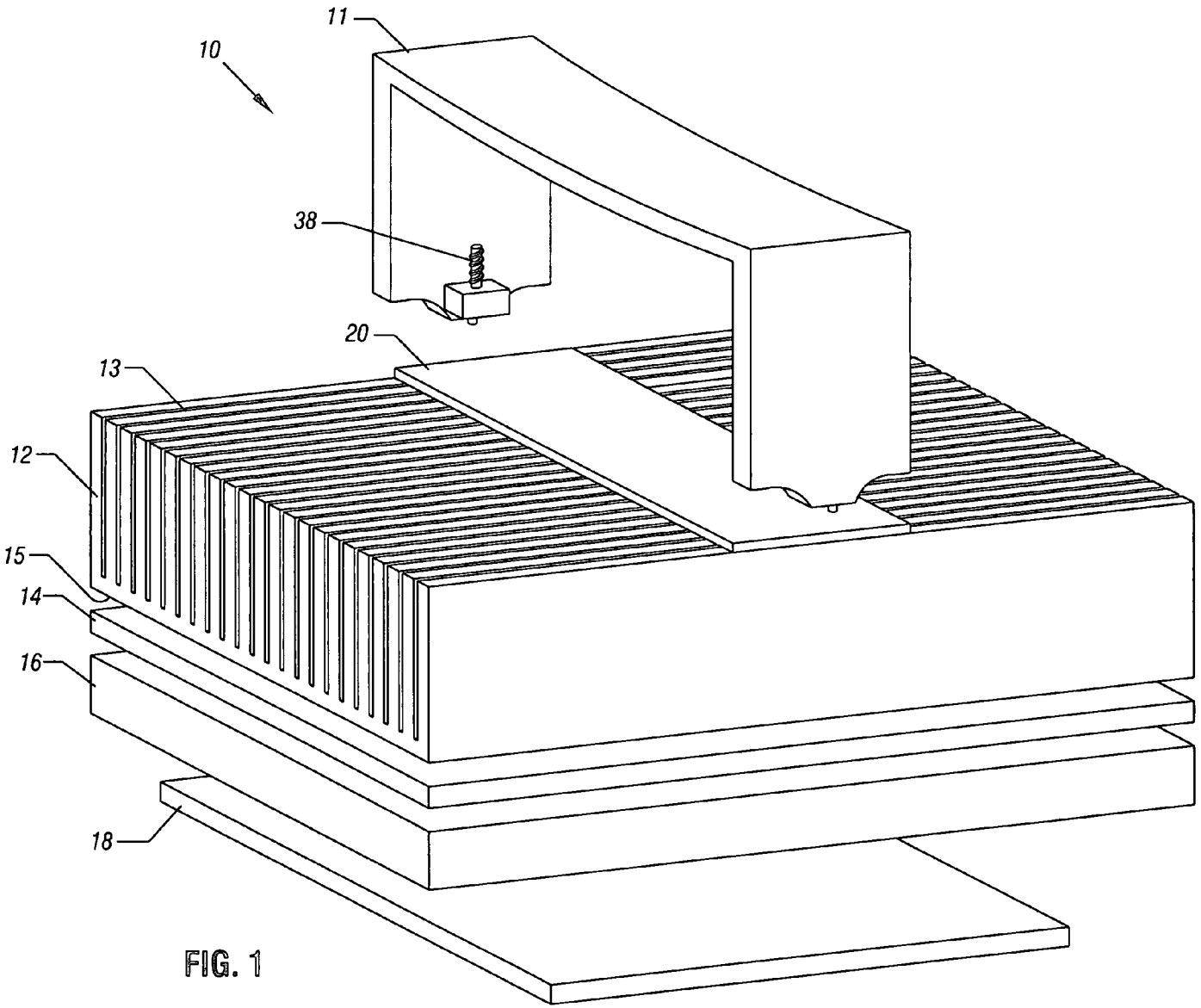
FIG. 1 is an exploded view of one embodiment of the present invention.

Referring to FIG. 1, a finned heat sink 12 may include a large number of fins 13 coupled by a flexible base 15. The fins 13 may be formed as parallel plates secured to the base 15 in one embodiment of the present invention. Below the heat sink 12 is a thermoelectric cooler 14. Underneath the thermoelectric cooler is a vapor chamber 16 for the thermoelectric cooler 14. A vapor chamber support frame 18 underlies the vapor chamber 16.

Figure 2:
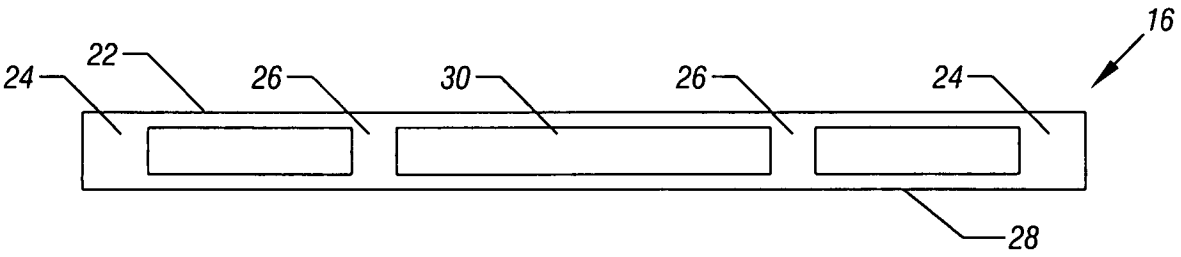
FIG. 2 is an enlarged, cross-sectional view of the vapor chamber shown in FIG. 1 in accordance with one embodiment of the present invention.

Referring to FIG. 2, the vapor chamber 16 may include a top wall 22, a bottom wall 28, and a sidewall 24. Standoffs 26 may allow room for a liquid/vapor phase 30 between the walls 24 and 28.

Figure 3:
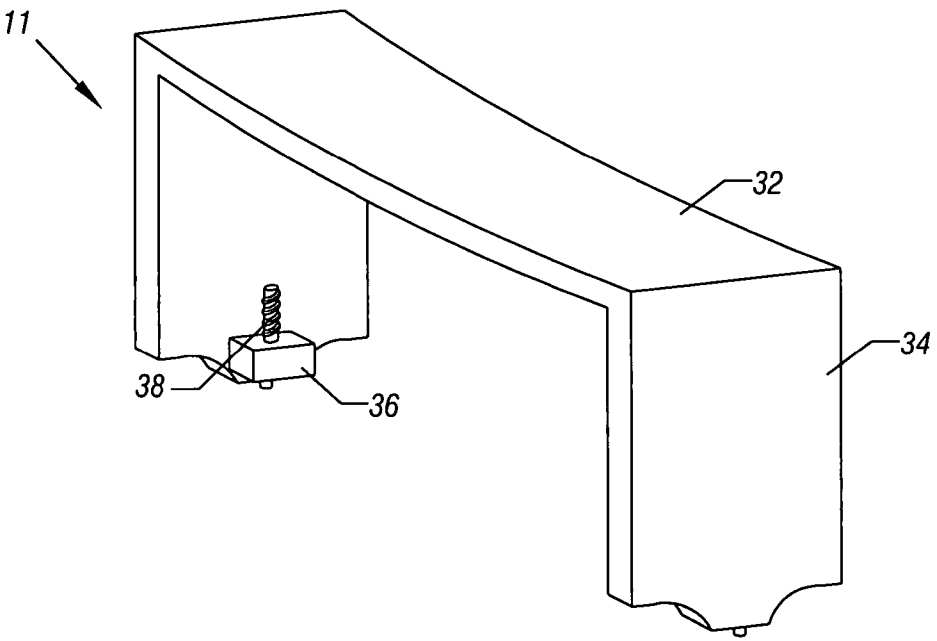
FIG. 3 is a perspective view of the retention band shown in FIG. 1 in accordance with one embodiment of the present invention.

Referring to FIG. 3, in accordance with one embodiment of the present invention, a U-shaped clamp or retention band 11 may include a bowed or pre-bent, leaf spring connecting portion 32 and downwardly extending transverse arms 34. The free end of each arm 34 may include a bolt retainer 36 and an upstanding bolt 38 in one embodiment of the present invention. The band 11 may be resilient in one embodiment.

Figure 4:
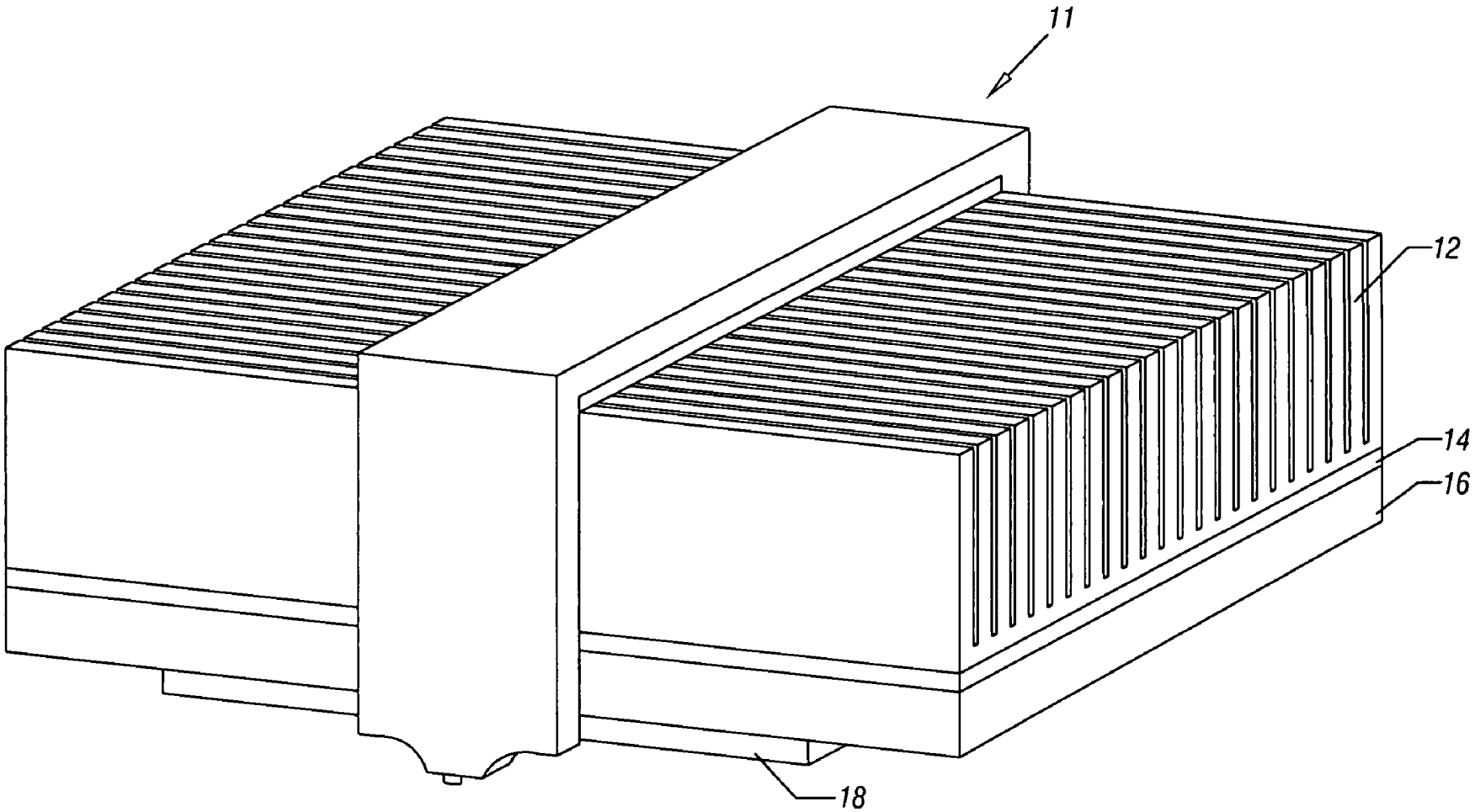
FIG. 4 is a perspective view of the assembled cooling device in accordance with one embodiment of the present invention, viewed at an angle from above.
Figure 5:
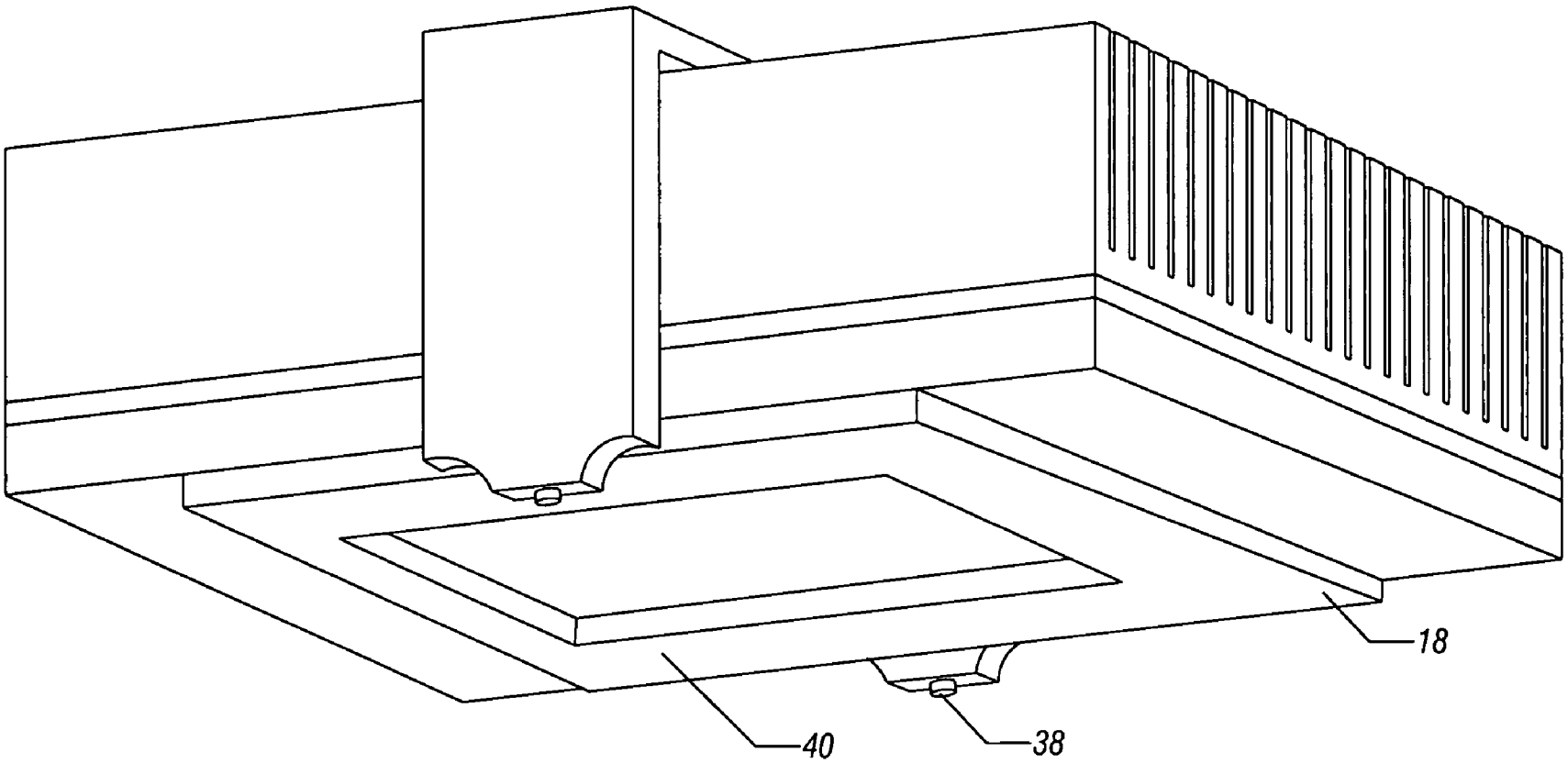
FIG. 5 is a perspective view corresponding to FIG. 4, viewed from below.

The components of FIG. 1 may be secured together using the retention band 11. In particular, as shown in FIGS. 4 and 5, the band 11 may traverse the heat sink 12. Damage to the heat sink 12 may be avoided by providing the fin array plate 20, which further stabilizes the heat sink 12. The entire structure is clamped together by the juxtaposition of the bolts 38 against the bottom of the vapor chamber support frame 18. In some embodiments, the amount of force applied may be adjusted by adjusting the amount by which the bolts extend through the retention units 36. In addition, the force applied is controlled by the pre-bending of the connecting portion 32.

Figure 6:
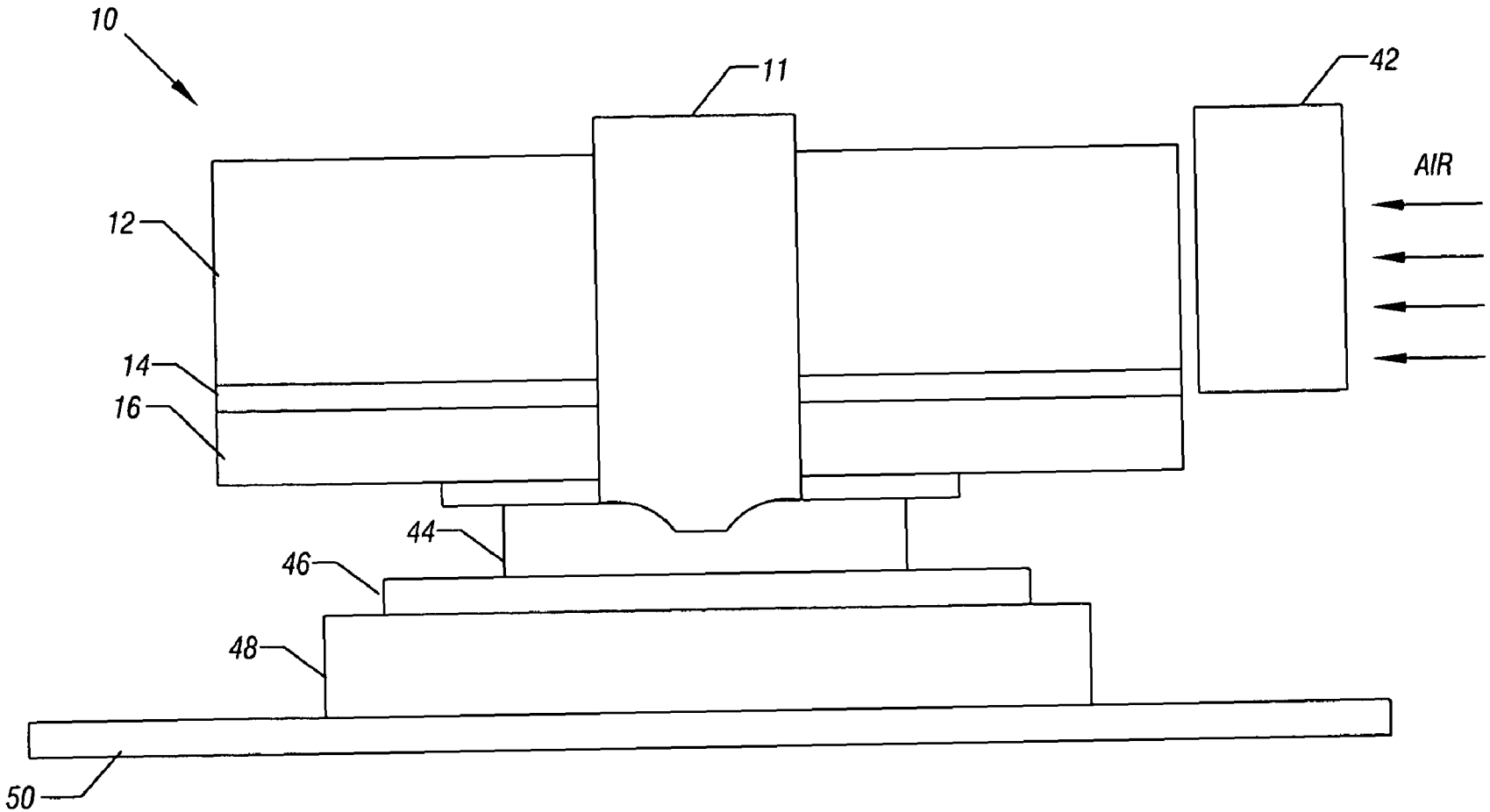
FIG. 6 is a side view of a system using the cooling structure shown in FIGS. 1 through 5 in accordance with one embodiment of the present invention.

Referring to FIG. 6, the cooling structure 10 may be mounted over a package 44 having a shape adapted to receive the bolts 38 and bolt retainers 36. A substrate 46, socket 48, and a printed circuit board 50 may be provided to connect the cooling device 10 to an appropriate electronic system. A fan 42 may force air through the heat sink 12, in one embodiment of the present invention, in a direction parallel to the length of the heat sink fins 13. Heat given off by the thermoelectric cooler 14 is removed to the atmosphere by the flow of air over the heat sink 12.

In some embodiments, the components may be made up by providing a thermal interface material, such as grease, between the various layers. A minimum pressure between the thermoelectric cooler surfaces, the heat sink, and the vapor chamber may provide the desired thermal resistance at those interfaces. In some cases, it is advantageous to provide the air flow from the side of the heat sink instead of the top. Multiple retention bands may be utilized to ensure that the load is spread evenly across the entire fin array in some embodiments. If it is desired to maintain the open area at the top of the fin array, several smaller bands, spaced from one another, may be employed. In other cases, a single, solid, retention band may be utilized.

In some embodiments, a thermoelectric cooler stackup may be utilized without providing unnecessary bending. These bending problems may break the good thermal interface between the components. It may also be desirable to provide the stackup without unduly thickening the base of the heat sink. Because of the band 11, the compressive load may be distributed over the entire fin array in some embodiments. In addition, using threaded connectors may interfere with the operation of the thermoelectric cooler and may result in loss of heat transfer area.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

clamping a heat sink to a thermoelectric cooler over a vapor chamber using a clamp that extends at least partially around said cooler and said vapor chamber over fins extending from said heat sink.

2. The method of claim 1 including clamping a heat sink using a U-shaped member which clamps to a plate underneath the heat sink and extends around and over the heat sink from side to side.

3. The method of claim 2 including providing free ends on said U-shaped member and providing adjustable threaded members on the free ends of said U-shaped member.

4. The method of claim 1 including providing a reinforcement over the top of the heat sink to underlie the clamp.

5. The method of claim 1 including providing a stack of said heat sink, a heat spreader, a thermoelectric cooler, and a vapor chamber.

6. The method of claim 5 including providing a support frame underneath said vapor chamber.

7. The method of claim 6 including clamping a U-shaped clamp on an underside of said support frame.

8. The method of claim 7 including causing said clamp to extend from the underside of said support frame, around the side of said heat sink, over said heat sink, down an opposite side of said heat sink, and under said support frame on the opposite side.

9. The method of claim 8 including providing an adjustment means at an interface between said clamp and said support frame.

10. The method of claim 9 including providing a clamp with a connecting portion and a pair of transversely extending arms, said connecting portion being bowed and said arms being resilient.

11. The method of claim 10 including arranging said connecting portion to press against an upper surface of said heat sink when said transversely extending arms are clamped underneath said heat sink to provide a spring biased compression between said clamp and said heat sink.

12. A clamp comprising:

a bowed leaf spring connecting portion; and a pair of transversely extending arms extending from opposed ends of said portion wherein said portion bows toward said arms, said arms to wrap around a vapor chamber, a thermoelectric cooler, and a heat sink, said arms to secure said heat sink to said thermoelectric cooler and vapor chamber.

13. The clamp of claim 12, said arms having free ends and including an adjustment element on the free ends of said arms.

14. The clamp of claim 13 wherein said adjustment element includes a threaded member.

15. A cooling assembly comprising:

a heat sink having fins;

a vapor chamber;

a thermoelectric cooler; and a U-shaped clamp extending over said fins and under said vapor chamber and thermoelectric cooler to clamp said vapor chamber and cooler to said heat sink.

16. The assembly of claim 15 including a strip extending over said fins, and under said U-shaped clamp.

17. The assembly of claim 15 wherein said clamp includes a bowed leaf spring connecting portion and a pair of transversely extending arms extending from opposed ends of said portion.

18. The assembly of claim 17 including threaded members on the free ends of said arms.

19. The assembly of claim 15 including a vapor chamber coupled to said cooler.

20. The assembly of claim 19 including a vapor chamber support frame coupled to said vapor chamber.

21. The assembly of claim 15 wherein said U-shaped clamp includes a bowed portion extending over said fins, said bowed portion being resilient.

22. The assembly of claim 15 including a vapor chamber and a vapor chamber frame, said U-shaped clamp extending over said fins, said cooler, said vapor chamber, a thermoelectric cooler, and abutting against said vapor chamber frame.

* * * * *